United States Patent [19]

Bailard

[11] Patent Number: 4,484,836

[45] Date of Patent: Nov. 27, 1984

[54] PNEUMATIC SPAR SEDIMENT CONTROL CURTAIN

[76] Inventor: James A. Bailard, 5333 Ogan Rd., Carpinteria, Calif. 93013

[21] Appl. No.: 401,948

[22] Filed: Jul. 26, 1982

[51] Int. Cl.[3] ..... E02B 8/02

[52] U.S. Cl. ..... 405/74; 405/64; 405/68; 405/103

[58] Field of Search ..... 405/63, 64, 68, 74, 405/15, 21, 25, 87, 103, 115

[56] References Cited

U.S. PATENT DOCUMENTS

| | | | |
|---|---|---|---|
| 3,922,861 | 12/1975 | Grihangne | 405/64 |
| 3,984,987 | 10/1976 | Light | 405/63 |
| 4,089,179 | 5/1978 | Trautman | 405/74 |
| 4,252,461 | 2/1981 | Colamussi et al. | 405/64 X |

FOREIGN PATENT DOCUMENTS

| | | | |
|---|---|---|---|
| 1349328 | 4/1974 | United Kingdom | 405/64 |

*Primary Examiner*—David H. Corbin

*Attorney, Agent, or Firm*—James E. Brunton

[57] ABSTRACT

An apparatus for preventing intrusion of sediments into quiet water berthing areas which is particularly adapted for use in berthing areas of the type having spaced apart fixed structures extending downwardly to the floor of the water body and defining an opening to the berthing area of a size sufficient to permit the ingress and egress of transiting vessels. The apparatus includes a spar curtain barrier made up of a plurality of flexible sections each of which comprises a ballasted spar buoy to which a length of flexible curtain fabric is attached. The sections are secured together to form an integrated structure adapted, in its closed position, to extend between the spaced apart fixed structures defining the berthing area. The spar curtain depends downwardly to a level proximate the floor of the berthing area and can be opened by a single workman in a short period of time to permit the entry or exit of the transiting vessels. In its open position the curtain barrier is neatly and compactly stacked, in an accordion-like fashion, against one of the fixed side structures of the berthing area.

8 Claims, 4 Drawing Figures

PNEUMATIC SPAR SEDIMENT CONTROL CURTAIN

BACKGROUND OF THE INVENTION

1. Field of the Invention

The present invention relates generally to an apparatus for controlling unwanted sedimentation within estuarine harbors. More particularly the invention concerns a novel apparatus comprising a segmented, pneumatic spar curtain which extends across the mouth of a quiet water berthing area and prevents the intrusion of flocculated clay sediments and the like into the area.

2. Discussion of the Prior Art

Effective control of sediments within quiet water marine facilities has presented substantial difficulties. For the most part these unwanted sediments are transported by rivers in a largely dispersed state, but upon reaching the more saline estuarine waters, they flocculate and become concentrated in the lower region of the water column. The sediment is then moved about by tidal and other currents until reaching quiet water areas, where it settles out and is deposited on the bottom.

Present methods of controlling unwanted sedimentation within estuarine harbors generally consists of periodically removing the accumulated sediment using conventional hydraulic or mechanical dredges. Several prior art inventions are directed toward methods and apparatus for such purposes. For example, U.S. Pat. No. 3,486,253 discloses a floating earthmoving device and U.S. Pat. No. 3,629,963 discloses an apparatus for leveling the floor of harbor areas. However, these types of methods are rapidly becoming uneconomical because of rising energy costs and because of the decreasing availability of nearby disposal sites.

Recently, the development of alternatives to dredging methods has begun. One method which has shown considerable promise has been the passive curtain barrier concept. The curtain acts to exclude the sediment-ladened bottom water from the protected area by forming a tight seal along its bottom and sides. The vertical stratification of the waters prevents the bottom water from over-topping the curtain barrier. The surface waters, however, are free to move in and out of the berthing area with the tide. One problem which has hindered full utilization of this concept has been the lack of an efficient method of opening and closing the curtain to accomodate transiting vessels. Various suggestions have been made for opening and closing the curtain barrier, including apparatus which rely on a tidal coordinated lifting procedure. Such approaches typically use equipment which embodies large surface floats and adjustable lengths of lifting chains. However, these approaches for opening and closing the curtain have proven generally unsatisfactory being both time consuming and labor intensive. The curtain has to be opened and closed at high tide and a full cycling of the curtain requires three separate visits by harbor personnel, namely a visit at low tide to shorten the chains; a visit at high tide to open the curtain; and, after moving the vessel into the berth and closing the curtain, a visit at low tide to once again lengthen the chains. Another difficulty with this method is that the actual opening and closing of the curtain must be accomplished using a small vessel.

Various other approaches for controlling unwanted sedimentation, including flotation barrier concepts, have been suggested. For example U.S. Pat. No. 3,984,987 discloses a floating barrier apparatus for accomplishing silt and pollution control. U.S. Pat. No. 3,708,983 discloses a series of air-retaining structural units connected together in a complete loop and U.S. Pat. No. 3,691,773 discloses a water barrier flotation curtain comprising a barrier having a sandwich-like construction. However, each of these prior art approaches has proven unsatisfactory for practical, cost effective control of sedimentation in quiet water berthing areas.

Applicant is also familiar with the following prior art patents which represent the closest art known to applicant and which serve to vividly demonstrate the uniqueness of the invention described and claimed hereinafter:

U.S. Pat. No. 3,640,073 — Frank J. Samsel
U.S. Pat. No. 3,974,655 — Halpern et al
U.S. Pat. No. 4,248,547 — Norman D. Brown

SUMMARY OF THE INVENTION

The apparatus of the present invention for preventing intrusion of sediments into quiet water berthing areas is adapted for use in berthing areas of the type having spaced apart fixed structures extending downwardly to the floor of the water body and defining an opening to the berthing area of a size sufficient to permit the ingress and egress of transiting vessels. The apparatus includes a spar curtain barrier made up of a plurality of flexible sections each of which comprises a ballasted spar buoy to which a length of flexible curtain fabric is attached. The sections are secured together to form an integrated structure adapted, in its closed position, to extend between the spaced apart fixed structures defining the berthing area. The spar curtain depends downwardly to a level proximate the floor of the berthing area and opens in an accordian-like fashion to permit the entry or exit of the transiting vessels.

In its closed position the spar curtain takes advantage of the vertical stratification of the estuarine waters by preventing the ingress of the sediment-ladened nearbottom water into the berthing area. The curtain, however, is not a total barrier, for its height is somewhat less than the total water depth. In this way, the relatively sediment-poor surface waters are free to participate in normal tidal exchange.

It is an object of the invention to provide a pneumatic spar sediment control apparatus of the character described in the preceeding paragraphs which is easy to operate and which can be opened and closed in a short period of time by a single person. This feature is extremely important in a water front environment because it minimizes the amount of advanced notice required for a ship's arrival.

It is another object of the invention to provide an apparatus of the aforementioned character which is highly reliable in operation and in which the spar curtain is always under control during the opening and closing operations even in conditions of extreme tidal currents.

It is still another object of the invention to provide an apparatus of the character described in which the flexible sections which make up the spar curtain can be closely accordianed together so as to take up a minimum amount of space when the curtain is in an open position.

It is another object of the invention to provide a pneumatic spar sediment control apparatus of the type heretofore discussed which employs a unique, closed volume ballasting concept which enables the entire spar curtain to be raised and lowered uniformly without the need to separately control the ballasting or deballasting of the individual spar bouys which support the flexible curtain. This important feature minimizes the stresses imparted to the curtain as it is being raised and lowered.

It is a further object of the invention to provide an apparatus of the character previously described in which the curtain can readily be opened and closed by means of a single, unique reeling mechanism disposed on one of the two vertically spaced fixed structures which define the sides of the berthing area.

Still another object of the invention is to provide an apparatus of the type described in which segmented, adjustable bottom weights and surface floats are provided along the entire length of the spar curtain to maintain the curtain taut and ensure a continuous uniform seal along the floor of the berthing area opening.

It is yet another object of the invention to provide a novel pneumatic spar sediment control apparatus which is of simple design, is inexpensive to manufacture, can be operated using standard city water hook-ups, is highly effective in preventing sediment build-up in the berthing area and is durable and reliable in use.

DESCRIPTION OF ONE FORM OF THE INVENTION

Figure 1:
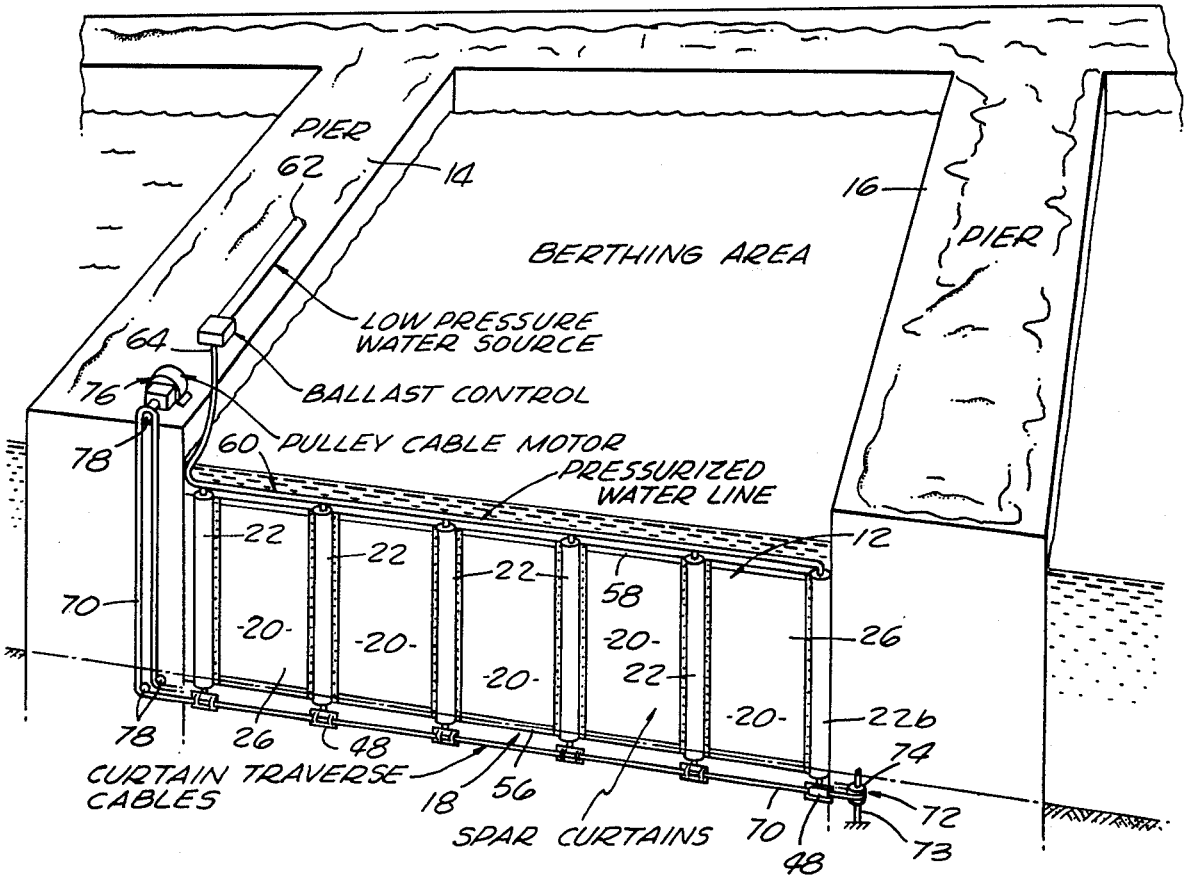
FIG. 1 is a perspective view of a berthing area showing the spar curtain barrier of the apparatus of the invention extending across the opening to the berthing area.
Figure 2:
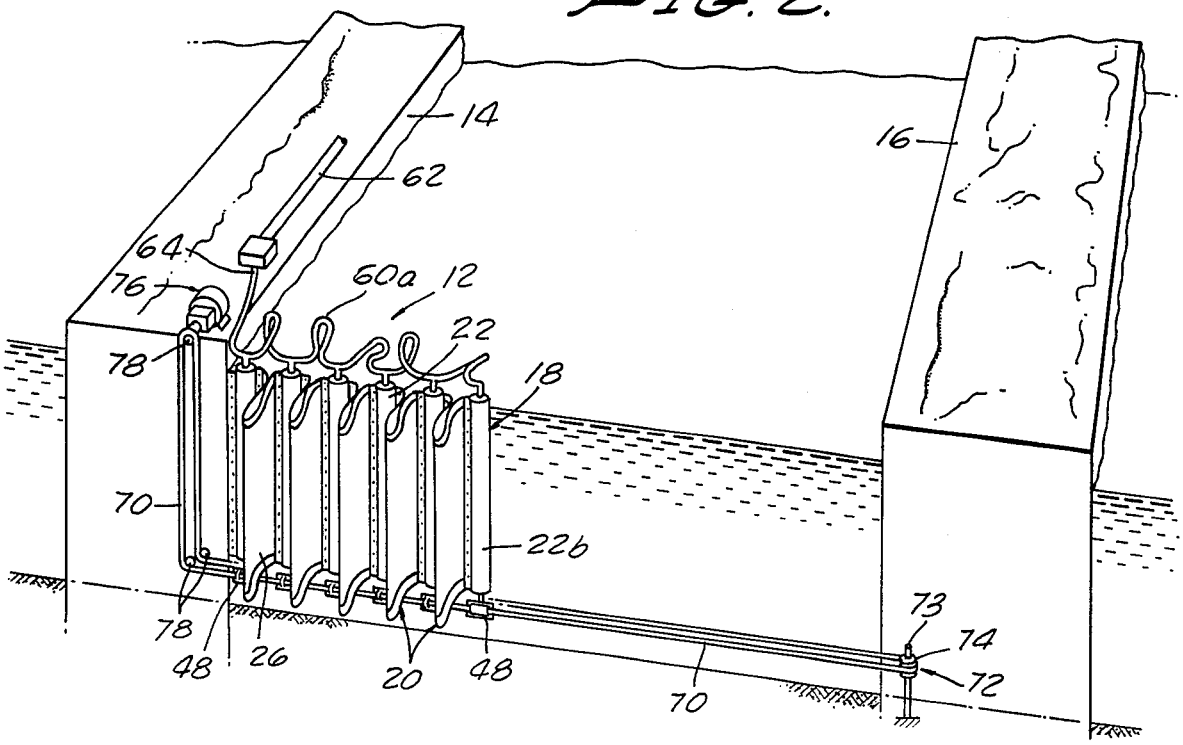
FIG. 2 is a perspective view similar to FIG. 1, but showing the spar curtain barrier in an open, accordioned position so as to permit ingress and egress of transiting vessels to the berthing area.

Referring to the drawings, and particularly to FIGS. 1 and 2, the apparatus of the invention for preventing infusion of sediment into the berthing area is designated generally by the numeral 12. A berthing area of the type adapted to be closed by the apparatus of the invention includes spaced apart fixed side structures 14 and 16 which define at their outer extremities the opening to the berthing area. In FIG. 1 the berthing area is shown closed by the apparatus of the invention. The side structures 14 and 16 protrude outwardly from a dock area 17 and extend downwardly to the floor of the water body of the berthing area.

In the embodiment shown in the drawings, the apparatus of the invention comprises a spar curtain barrier 18 made up of a plurality of adjacent flexible sections 20 which are secured together to form an elongated integrated structure, or barrier, adapted in its closed position to extend between the spaced apart fixed structures 14 and 16 of the berthing area proximate their outer extremities and to depend downwardly to a level proximate the floor of the water body of the berthing area. To open the berthing area to transiting vessels, the spar curtain barrier is adapted to accordion together toward one end of the fixed structures, for example, side structure 14 (FIG. 2). The precise method by which the spar curtain barrier is accordioned into its open position will be discussed in detail in the paragraphs which follow.

Figure 4:
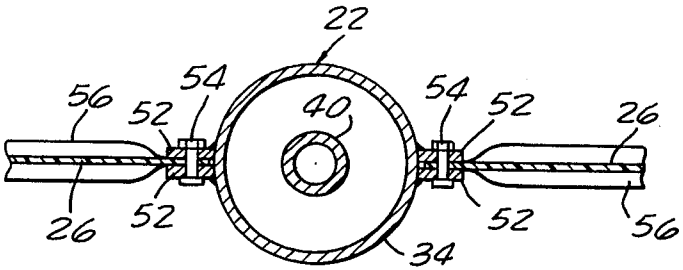
FIG. 4 is a cross-sectional view taken along lines 4—4 of FIG. 3.
Figure 3:
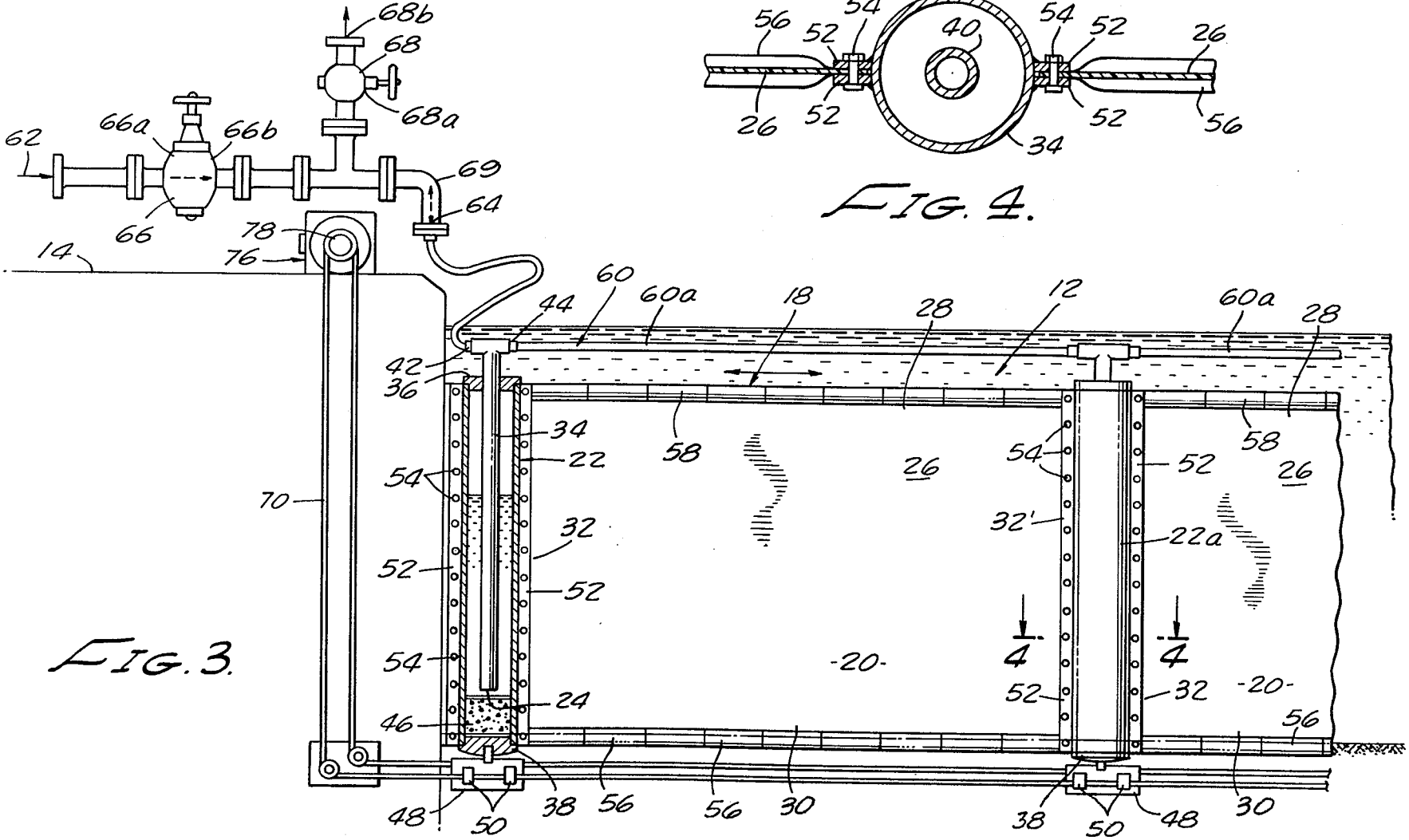
FIG. 3 is a fragmentary elevational view, partly in cross-section, showing a portion of the spar curtain barrier disposed adjacent to the left side of the berthing area as viewed in FIG. 1.

Referring now to FIGS. 3 and 4, each flexible section 20 of the spar curtain barrier comprises at least one flotation member 22 having a fluid inlet 24, and a flexible curtain panel 26 having a top, a bottom and a pair of spaced apart edges 28, 30 and 32 respectively. The flexible curtain material used in constructing the curtain panels is made from a strong impermeable fabric such as a fabric manufactured by DuPont and sold under the trademark HYPALON. As shown in FIG. 3, the flexible curtain is connected along one edge 32 to the hollow body 22 and is adapted to be connected along its opposite edge 32' to the hollow body of the flotation member of the next adjacent barrier section, designated in FIG. 3 by the numeral **22*a***.

In the present embodiment of the invention, the sealed hollow body portion of the flotation member is provided in the form of an elongated, generally cylindrically shaped member 34 which is sealed at either end by upper and lower cap members 36 and 38 respectively (FIG. 3). Extending through, and sealably connected to, the upper cap member 34 is an elongated pipe 40 which depends into the cylindrical shaped member 34 a substantial distance and defines at its lower extremity the previously mentioned fluid inlet 24 to the flotation member. The upper end of pipe 40 is "T" shaped defining a fluid inlet 42 and a fluid outlet 44. The bottom portion of each flotation member 22 is preferably ballasted with a dense material such as sand or concrete 46. Affixed to cap 38 and located at the base of each flotation member is a generally planar shaped anchor plate 48. Provided on each anchor plate 48 are cable guide means shown here in the form of spaced apart "U" shaped brackets 50 affixed to and extending outwardly from one face of the anchor plate. The purpose of these cable guide means will presently be discussed.

The flexible curtain panels 26 can be constructed of variable height, but are preferably of a height somewhat less than the full water depth of the berthing area at which the apparatus is installed. As best seen by referring to FIG. 4, each curtain panel 26 is attached to a flotation member 22 by means of a water-tight seal. Although the attachment of the curtain panel to the flotation member can be made in various ways, it is shown here being accomplished using spaced apart flange members 52 which are connected to, and extend radially outwardly from, the cylindrical member 34. The edge portion 32 of each of the curtain panels 26 is sandwiched between the flange members 52 and is securely clamped in place by a plurality of vertically spaced fasteners 54 which extend through the flange plates and the curtain panels in the manner shown in FIGS. 3 and 4.

The spar curtain barrier further includes ballast means connected along the bottom of the individual curtain panels 26 for biasing the curtain barrier downwardly toward the floor of the water body and flotation means connected along the top of the individual curtain panels 26 for opposing the downward bias of the ballast means. In this way the flexible curtain panels 26 will continuously be maintained taut. While the ballast means may be provided in various configurations, a segmented sand filled tube 56 of the character shown in the drawings has proven satisfactory for accomplishing the downward biasing function. Similarly, the flotation means can take various forms, but is shown here as comprising a segmented float tube 58 which is attached to the top portion 28 of each of the flexible curtain sections 26. This float tube can be constructed of cork, styrafoam, treated wood or other suitable flotation materials.

A unique feature of the apparatus of the present invention is the use of a closed volume ballasting concept to enable the spar curtain barrier to be uniformly raised and lowered. This novel ballasting method is accomplished through the use of a water supply means, which is operably interconnected with a source of water under pressure, and which, through a suitable control means, simultaneously provides water to the fluid inlet of each of the sealed flotation members. Referring once again to FIGS. 1 and 2, the component parts of the water supply means can be seen to include a supply line 60 made up of a plurality of elongated flexible conduits 60*a*, the ends of which are sealably interconnected with the inlets and outlets 42 and 44 of each of the "T" shaped upper extremities of the pipes 40. Disposed between the low pressure water source 62 and inlet 64 of the supply line 60 is a control means for controlling the flow of water through the supply line 60 toward and away from the fluid inlets 24 of each of the flotation members 22.

Referring to FIG. 3, the control means of the present embodiment of the invention comprises two cooperating valves 66 and 68. Valve 66 is connected at its inlet end 66*a* with the low pressure water source 62 and is connected at its outlet side 66*b* with a length of rigid hook-up pipe 69 which in turn is connected to the inlet 64 of the supply line 60. The inlet portion 68*a* of valve 68 is interconnected with length of rigid pipe 69 intermediate its ends and the outlet port 68*b* thereof is vented to atmosphere.

Ballasting and de-ballasting of the flotation members using the closed volume ballasting concept is accomplished in the following manner. With valve 68 of the control means closed, opening of valve 66 will cause water from the low pressure water source to flow through length of rigid pipe 69 into water supply line 60 and then downwardly through each of the pipes 40 which depend into each of the flotation members 22 and into the interior of the flotation member through inlet 24. As the water under pressure flows into the flotation members 22, they will be biased downwardly due to the weight of the water therewithin. At the same time, the water flowing into the sealed flotation members will cause the air trapped inside the flotation members to be compressed between the surface of the water and the upper cap 36 of each flotation member. With the unique arrangement of the ballasting system of the invention, the ballasting and deballasting process is self-balancing. If one flotation spar starts to fill faster than the others, the increased air pressure in the spar slows the filling until the others have caught up. Similarly, if one spar starts to empty faster than the others, the decreased pressure inside the spar slows the outflow of water allowing the others to catch up.

Continued flow of water from the low pressure source through open valve 66 toward the flotation members will cause the spar curtain barrier to sink into a position wherein the anchor plate 48 depending from each of the flotation members will penetrate the soft mud bottom of the berthing area allowing the segmented ballast tube 56 which extends along the base of the spar curtain barrier, to seal itself to the mud bottom of the berthing area. In this position, the top of the spar curtain barrier is perferably below the surface of the water by a distance of approximately two feet so that the relatively sediment poor surface waters in the water body are free to particiate in normal tidal exchanges. With the barrier thusly positioned, valve 66 is closed.

When it is desired to raise the spar curtain barrier so that it may be opened to admit entrance or exit of a transiting ship, the following procedure is followed: With valve 66 closed, valve 68 is opened placing water supply conduit 60 in communication with atmosphere. This permits the water ballast in each flotation member to be expelled through tubes 40 by the air compressed internally within each of the flotation members. Once the spar curtain barrier and the flotation members are free of the bed of the berthing area, valve 68 is closed and the curtain is ready to be moved into an open position in an accordion-like fashion.

The actual opening of the spar curtain barrier is accomplished through the use of novel operating means, which, in the embodiment of the invention shown in the drawings, comprises an endless loop of cable 70 extending across the floor of the opening of the berthing area, and cable reeling means for acting on the cable to move it in a first and second direction. As best seen in FIG. 4 one side of cable loop 70 is adapted to be slidably received in, and guided by, each of the cable guide means provided at the base of each of the flotation members 22. Also forming a part of the operating means is an anchor means designated by the numeral 72 (FIGS. 1 and 2). Anchor means 72, which comprises an anchor stake 73 and a sheave 74, is located on the opposite side of the berthing area from the side upon which the cable reeling means is positioned and is adapted to be operably connected with the loop of cable 70 in a manner so as to maintain it in position across the floor of the opening to the berthing area. Cable receiving sheave 74 is rotatably carried by the anchor stake 73 and receives the cable loop 70 to enable it to be selectively pulled by the reeling means either in a clockwise or counterclockwise direction.

The reeling means in the present form of the invention comprises a pulley cable motor 76 mounted on side 14 of the berthing structure and a series of cooperating sheaves 78 about which the cable loop passes and about which it is driven in either a first or second direction.

By connecting the cable of the cable loop to the last flotation member in the barrier (designated as 22*b* in FIG. 1), the reeling of the cable loop in one direction will cause the spar curtain to move from the closed position shown in FIG. 1 to the open position shown in FIG. 2. Reversal of the direction of travel of the cable loop will cause the barrier to once again move into its closed position. With this arrangement a single person can easily open and close the barrier curtain in a rapid, positive and controlled manner.

OPERATION

Normally the berthing area is closed by the spar curtain barrier of the invention. In its closed position the anchor plates 48 and the segmented ballast tube 56 of the apparatus are at least partially embedded in the mud on the floor of the berthing area opening. However, the top of the spar curtain barrier is maintained slightly below the surface of the water so that the surface waters are free to participate in the normal tidal exchange.

When it is desired to open the barrier, valve 68 is opened so that the air trapped in the upper portion of each of the flotation members will force the ballasting water out through openings 24 in the depending pipes 40. As the ballasting water is expelled, the barrier curtain will uniformly rise due to the increased bouyancy of the flotation members and the anchor plates and segmented ballasting tube will become free of the bottom mud. With the barrier curtain thus raised pulley cable motor 76 is energized causing the cable loop to be pulled in a first direction around the guide sheaves 78. Continued pulling of the cable in this first direction will cause the barrier curtain to move into the position shown in FIG. 2. This permits the currents to act upon the sediment which has build up along the lower face of the barrier in its closed position, whereby sheaves 78 and the lower portion of stake 73 are exposed as shown in FIG. 2.

To close the barrier curtain, motor 76 is driven in a reverse direction, causing the cable loop to travel in a second direction. When the curtain reaches the position shown in FIG. 1 the motor is automatically de-energized and the ballasting process can be started. This is done by closing valve 68 and opening valve 66 to allow ballasting water to flow uniformly into each of the flotation members. As the flotation members fill with water the barrier curtain will gently and uniformly sink to a position wherein the bottom edge thereof is in sealing engagement with the mud on the bottom of the berthing area opening.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. An apparatus for preventing infusion of sediments into a berthing area of the type having spaced apart, fixed side structures extending downward to the floor of the water body and defining at their outer extremities the opening to the berthing area, said apparatus comprising:

(a) a spar curtain barrier made up of a plurality of adjacent flexible sections secured together to form an elongated integrated structure adapted, in its closed position, to extend between the spaced apart fixed structures of the berthing area proximate their outer extremities and to depend downwardly to a level proximate the floor of the water body and, in its open position, to accordion together toward one of the fixed structures, each said flexible section comprising:

(1) at least one flotation member comprising sealed hollow body having a fluid inlet; and (2) a flexible curtain having a top, a bottom and a pair of spaced apart edges, said curtain being connected along one edge to said hollow body and adapted to be connected along its opposite edge to said hollow body of the flotation member of the next adjacent barrier section;

(b) water supply means operably interconnecting a source of water under pressure with said fluid inlets of each of said flotation members for controllably introducing water under pressure into said hollow bodies thereof; and (c) operating means connected to one of said fixed side structures and operably associated with said spar curtain barrier for the opening and closing thereof.

2. An apparatus as defined in claim 1 in which said spar curtain barrier includes:

(a) ballast means connected along the bottom of said curtain barrier for biasing the said bottom thereof downwardly toward the floor of the water body; and (b) flotation means connected along the top of said curtain barrier for opposing the downward bias of said ballast means, whereby said flexible curtain of said curtain barrier will be maintained taut.

3. An apparatus as defined in claim 1 in which said sealed hollow body of each said flotation member comprises an elongated, generally cylindrical shaped member sealed at either end by upper and lower cap members and in which said fluid inlet comprises the lower extremity of an elongated pipe sealably connected to said upper cap member and depending into said cylindrically shaped member a substantial distance.

4. An apparatus as defined in claim 3 in which an anchor plate is affixed to and extends downwardly from the lower cap member of each said flotation member, said anchor plate being provided with cable guide means.

5. An apparatus as defined in claim 4 in which said operating means comprises:

(a) an endless loop of cable extending across the opening in the berthing area and adapted to be slidably received in, and guided by, each of said cable guide means; provided on each of said flotation members;

(b) reeling means carried by one of said fixed side structures and operably associated with said cable for pulling said loop of cable in either a clockwise or a counterclockwise direction; and (c) anchor means disposed proximate the other of said fixed side structures for receiving said loop of cable and for maintaining it in position across the opening in the berthing area.

6. An apparatus as defined in claim 1 in which said water supply means comprises an elongated flexible conduit having a water inlet and being sealably interconnected along its length with each of said fluid inlets of said flotation members and further includes control means disposed between said source of water under pressure and said flexible conduit water inlet for controlling the flow of water through said flexible conduit toward and away from said fluid inlets.

7. An apparatus for preventing infusion of sediments into a berthing area of the type having spaced apart, fixed side structures extending downward to the flow of the water body and defining at their outer extremities the opening to the berthing area, said apparatus comprising:

(a) a spar curtain barrier made up of a plurality of flexible sections secured together to form an elongated integrated structure adapted in its closed position to extend between the spaced apart fixed structures of the berthing area, and to depend downwardly to a level proximate the floor of the water body and in its open position to accordion together toward one of the fixed structures, each said flexible section comprising:

(1) at least one flotation member comprising an elongated hollow body sealed at either end and an elongated conduit depending into said hollow body a substantial distance said conduit having a fluid inlet exteriorly of said hollow body and a fluid outlet interiorly of said hollow body;

(2) a flexible curtain having a top, a bottom and a pair of spaced apart edges, said curtain being connected along one edge to said hollow body and adapted to be attached along its opposite edge to a hollow body of the flotation member of the next adjacent barrier section;

(3) ballast means connected to the bottom of said flexible curtain for biasing the said bottom of said curtain downwardly toward the floor of the water body; and (4) flotation means connected to the top of said flexible curtain for opposing the downward bias of said ballast means, whereby said flexible curtain will be maintained taut;

(b) water supply means operably interconnected with said conduits of said flotation members for introducing water under pressure into said hollow bodies thereof; and (c) operating means connected to one side of said fixed side structures and being operably associated with said spar curtain barrier for the opening and closing thereof, said operating means comprising:

(1) an endless loop of cable extending across the opening in the berthing area and adapted to be slidably interconnected with each of said flotation members;

(2) reeling means carried by one of said fixed side structures and operably associated with said cable for pulling said loop of cable in either a clockwise or a counterclockwise direction; and (3) anchor means disposed proximate the other of said fixed side structures for receiving said loop of cable and for maintaining it in position across the opening in the berthing area.

8. An apparatus as defined in claim 7 in which said water supply means comprises an elongated flexible conduit having a water inlet and being sealably interconnected along its length with each of said fluid inlets of said elongated conduits of said flotation members and further includes control means disposed between said source of water under pressure and said flexible conduit water inlet for controlling the flow of water through said flexible conduit toward and away from said fluid inlets of said elongated conduits.

* * * * *